United States Patent [19]

Richmond et al.

[11] Patent Number: 4,970,826

[45] Date of Patent: Nov. 20, 1990

[54] APPARATUS AND METHOD FOR OPENING AND CLOSING A GATE

[75] Inventors: Moscow K. Richmond, Los Angeles; Thomas R. Richmond, Santa Ana; Patrick S. Kochie, Simi Valley, all of Calif.

[73] Assignee: Door King, Inc., Inglewood, Calif.

[21] Appl. No.: 439,740

[22] Filed: Nov. 24, 1989

[51] Int. Cl.[5] ..... E05F 15/00

[52] U.S. Cl. ..... 49/139; 49/141; 49/340; 49/506

[58] Field of Search ..... 49/139, 140, 141, 340, 49/506

[56] References Cited

U.S. PATENT DOCUMENTS

| | | | |
|---|---|---|---|
| 4,159,599 | 7/1979 | Richmond | 49/140 X |
| 4,313,281 | 2/1982 | Richmond | 49/139 X |
| 4,330,958 | 5/1982 | Richmond | 49/280 |
| 4,403,449 | 9/1983 | Richmond | 49/139 X |
| 4,429,264 | 1/1984 | Richmond | 318/466 |

*Primary Examiner*—Philip C. Kannan
*Attorney, Agent, or Firm*—Robert J. Schaap

[57] ABSTRACT

A gate opening and closing apparatus for automatically moving a gate between opened and closed positions and where the gate can be unlatched in order to permit manual opening and closing movement and easily re-latched for automatic movement thereof. The apparatus comprises a powered drive unit. The gate is moveable and, preferably rotatable about a vertical hinge axis, between a pair of opposite end positions. A drive arm forms part of the opening and closing apparatus and is driven in an arcuate path between a pair of end positions which represent a gate open position and a gate closed position. A coupling arm is normally engaged with the drive arm and may be moveable therewith between the opposite end positions represented by movement of the drive arm. A latching arm is provided for latching the coupling arm to the drive arm. A connecting mechanism connects the coupling arm to the gate to translate the movement from the drive arm and the coupling arm to the gate. When the latching arm holds the coupling arm to the drive arm, the coupling arm will provide automatic movement of the gate. The latching arm is capable of being shifted away from the drive arm to preclude automatic movement of the gate and thereby permit a manual opening and closing of the gate.

15 Claims, 1 Drawing Sheet

APPARATUS AND METHOD FOR OPENING AND CLOSING A GATE

BACKGROUND OF THE INVENTION

1. Field of the Invention.

This invention relates in general to certain new and useful improvements in an apparatus and method for controlling the opening and closing movements of a gate, and more particularly to an apparatus and method of the type stated which utilizes a drive arm and coupling arm arrangement for enabling automatic opening and closing of a gate which permits separation of the coupling arm and drive arm to permit manual opening and closing of the gate.

2. Brief Description of the Prior Art.

Over the years, a variety of types and styles of gates have been developed to provide security for such areas as parking structures and entrances and exits to residential and industrial property. These gates may take the form of sliding gates which move in or on a track, or swinging gates which are rotatably hinged to a fixed structure. Where large passageways are involved, gates may be provided in pairs which operate from opposite sides of the openings.

Many control systems have been developed to provide automatic control for the opening and closing of gates. These control systems include an electric motor operatively connected to the gate to control its movement. Typically, the motor is controlled by a switch in the vicinity of the gate which can only be operated by authorized personnel. For example, the switch may be in the form of a key switch which can only be operated by use of a conventional key or by a card key.

In most of the prior art gate opening and closing apparatus, a positive locking mechanism was provided to physically and automatically lock the gate when it reached the closed position. In this way, only authorized access to a controlled area was achieved. Many of these prior art positive locking mechanisms relied upon the use of a solenoid operated lock which included a locking pin on the gate capable of being inserted into an opening on a fixed structure at the gate closed position. However, in each case, the gate was automatically and positively locked when it reached the closed position.

The locking of the gate at the closed position, while effective to provide a measure of security, poses many problems to the occupants of the controlled area as well as to public officials. If for some reason, there is a malfunction of the gate operating mechanism, it automatically locks at the closed position and the occupants on the inside of the controlled area would not have egress through the access opening covered by the gate. Thus, some means to physically unlock the gate has to be provided. In addition, in the event of power failure which could arise, as a result of disruption from an electrical utility supplier or as a result of a fire, it is necessary for public officials to have access to the controlled or secured area. Thus, some fire departments and other health control officials require a special unlocking mechanism located at the exterior of the gate and which is confined in a locked box or similar secured area to which they have special access. Many fire departments or other health or other public officials require a special key for access to these locked boxes or secured containers.

Notwithstanding, there are also many occasions in which the authorized user of the gate desires manual opening and closing movement of the gate as opposed to the automatic opening and closing movement. In essentially all other prior art gate opening and closing apparatus, in order to afford some mechanical and manual movement of the gate, complex disassembly of the gate opening and closing apparatus is required. This usually includes a need for access to the drive housing for purposes of uncoupling one or more gears in the drive housing. Thus, disengaging the automatic drive from the gate opening and closing mechanism is a complex and time consuming procedure.

In addition to the above, each of the prior art locking mechanisms also use a complex gear structure for purposes of driving the gate between the open®d and closed positions. While these gear boxes are effective, they are noisy and consume a substantial amount of the power generated by the electric motor. Moreover, it is virtually impossible to push a gate against the action of the gear box in the event of a power failure.

U.S. Pat. No. 4,159,599, dated July 3, 1979 by Moscow K. Richmond for "Gate Opening and Closing Assembly" discloses a gate which is slidable between opened and closed positions and which uses a solenoid operated locking mechanism. U.S. Pat. No. 4,313,281, dated Feb. 2, 1982 by Moscow K. Richmond for "Gate Opening and Closing Apparatus and Method" also discloses a positive locking mechanism for use in locking a gate when it reaches a gate closed position. U.S. Pat. No. 4,330,958 by Moscow K. Richmond, dated May 25, 1982 for "Gate Opening and Closing Assembly With Automatic Locking Means" also discloses a gate opening and closing assembly with an automatic locking means for locking the gate when it reaches a closed position. U.S. Pat. No. 4,429,264, dated Jan. 31, 1984, by Moscow K. Richmond, for "System and Method For The Automatic Control Of Electrically Operable Gates" discloses a gate opening and closing mechanism which utilizes automatic control features and which also provides for manual operation.

OBJECTS OF THE INVENTION

It is, therefore, one of the primary objects of the present invention to provide a gate opening and closing apparatus for automatic opening and closing of a gate and which also permits easy and relatively fast disconnection of the automatic drive from the gate for manual opening and closing by authorized personnel thereof.

It is another object of the present invention to provide a gate opening and closing apparatus of the type stated which utilizes a gate driving arm along with a coupling arm which is normally coupled to but is capable of being easily manually uncoupled from the driving arm to permit manual opening and closing of the gate.

It is a further object of the present invention to provide a gate opening and closing apparatus of the type stated which utilizes a unique co-action between a drive arm and a coupling arm to permit automatic driving movement of the gate and which permits easily accomplished manual separation of the coupling arm and the drive arm and which further includes a latching means for coupling the drive arm to the coupling arm to permit automatic driving movement of the gate.

It is an additional object of the present invention to provide a gate opening and closing apparatus of the type stated which is quiet in operation and which is also highly reliable in operation in which can be constructed at a relatively low cost.

It is another salient object of the present invention to provide a method of opening and closing a gate with automatic control movement by use of a latched drive arm and coupling arm and which method relies upon an unlatching of the coupling arm from the drive arm to permit manual movement thereof.

With the above and other objects in view, our invention resides in the novel features of form, construction, arrangement and combination of parts presently described and pointed out in the claims.

BRIEF SUMMARY OF THE INVENTION

A gate opening and closing apparatus for automatically moving a gate between opened and closed positions and where the gate can be unlatched from the apparatus to permit manual opening and closing. The gate can also be easily relatched for automated movement.

The gate opening and closing apparatus, in a preferred embodiment, comprises a powered drive unit. This drive unit usually includes an electric motor, along with a gear drive means for providing rotational power. A drive arm is operatively connected to the drive unit and is powered by the drive unit for movement between a pair of opposed end positions. In a preferred embodiment, the drive arm is pivotally mounted for rotational movement by the drive unit. The pair of opposite end positions of the drive arm affectively represent a gate opened position and a gate closed position.

A coupling arm is normally engaged with the drive arm and is moveable therewith between the pair of opposite end positions. The coupling arm and not the drive arm is connected to the gate by a connecting means, as hereinafter described. In this way, automatic movement of the gate between the gate opened and the gate closed positions is afforded when the coupling arm is latched to the drive arm. The coupling arm is capable of being moved away from the drive arm to thereby stop the automatic movement of the gate. This will then permit manual movement of the gate so that the gate is capable of being manually shifted between the gate opened and closed positions. The coupling arm is also capable of being shifted back to the engaged position with the drive arm and to thereby permit automatic movement of the gate.

The connecting means may adopt the form of a connecting arm, and which is connected between the coupling arm and the gate to translate movement from the drive arm to the gate. In this way, a complete translation of movement from the drive unit to the gate is provided. This type of mechanism is highly effective in providing swinging movement to the gate about a hinge point. However, this type of apparatus is also effective in the operation of sliding gates as opposed to swinging gates.

In a more preferred embodiment, the drive arm is preferably rotatable as aforesaid, and even more preferably rotates within a horizontal plane. In like manner, the coupling arm also preferably rotates in a horizontal plane. In this way, the drive arm may be latched directly to the coupling arm so that the two move together in a horizontal plane for providing opening and closing movement of the gate.

It is desirable to have the coupling arm and the drive arm rotating in the horizontal plane about the same pivot axis. For this purpose, both the drive arm and the coupling arm have coincident axes of rotation.

The coupling arm is latched to and unlatched from the drive arm by means of a locking arm often referred to as a "latching" arm. The latching arm is also preferably mounted for rotation between the opposite end positions representing the gate opened and gate closed positions. The latching arm serves to latch the drive arm to the coupling arm when the latching arm is moved to a locked position and permits separation of the drive arm from the coupling arm when the latching arm is moved to the unlatched position.

In a more preferred embodiment, the latching arm is also hingedly mounted in close proximity to the aforesaid pivot axis. In this way, the latching arm can be raised and lowered with respect to the coupling arm and the driving arm. When the latching arm is raised, the drive arm can be moved independently of the coupling arm, thereby interrupting with the translation of any driving action to the gate. However, when the latching arm is lowered into a position of engagement with the drive arm and the coupling arm, it will hold the coupling arm with respect to the drive arm. This will cause a translation of movement to the gate and thereby afford an automatic driving movement of the gate.

It is also desirable to provide a camming means associated with the latching arm or the coupling arm or both. This camming means will cause an automatic latching of the latching arm to the drive arm to the coupling arm when the drive arm is driven in a horizontal plane to a position at which the coupling arm may be resting. In this way, a complete automatic latching of the drive arm and the coupling arm can be afforded.

The present invention also provides a unique method of automatically moving a gate between a gate opened and a gate closed position and which permits unlatching from the gate drive mechanism to thereby afford manual and opening and closing movement of the gate.

In a preferred embodiment, the method comprises automatically driving a gate from a closed position to an open position and from an opened position to a closed position by means of a coupling arm which is latched to a drive arm. The method also provides for unlatching of the coupling arm from the drive arm to thereby permit separation of the coupling arm and the drive arm and thereby disconnecting any source of driving power to the gate. Finally, the method further includes the automatic coupling of the drive arm to the coupling arm when the drive arm is moved to a location where the coupling arm is positioned.

The term gate is used in a generic sense to include doors and like structures and essentially constitutes any movable frame work or structure which controls entrance or exit through an access opening to provide a passageway.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 2:
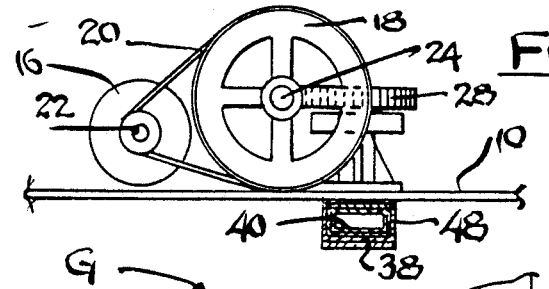
Figure 6:
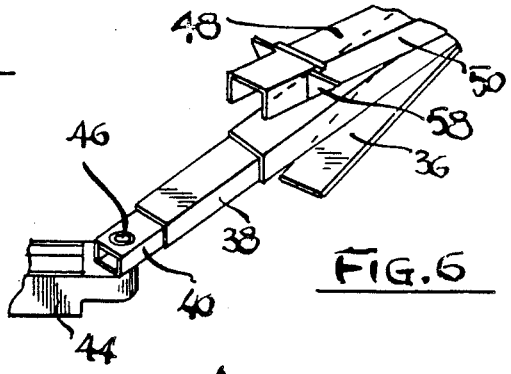
Figure 1:
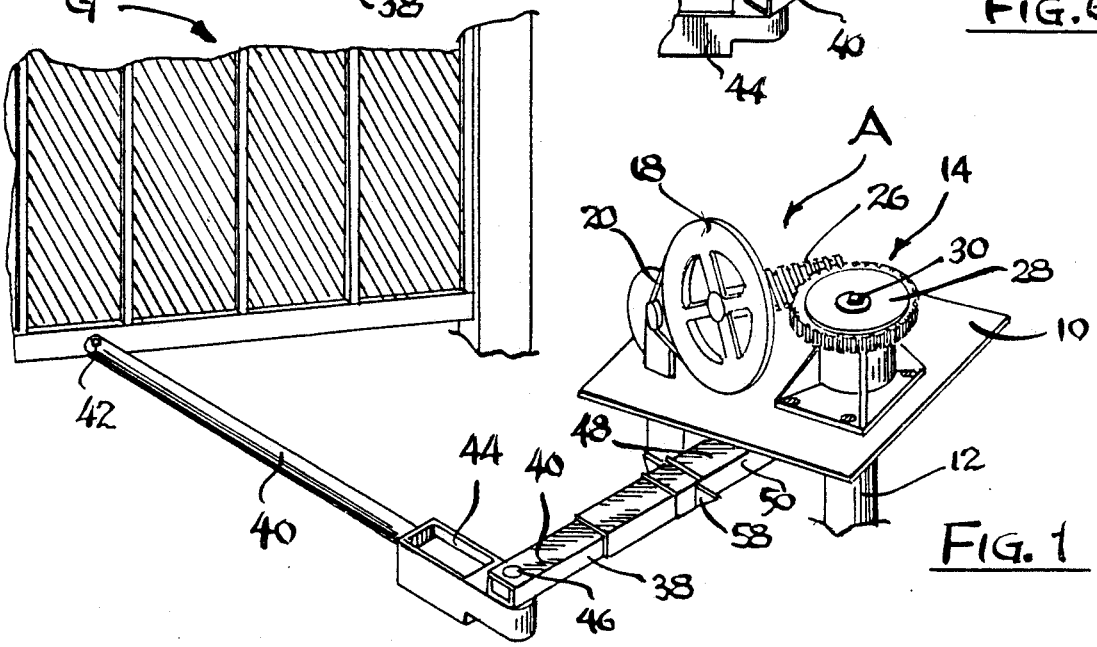
Figure 3:
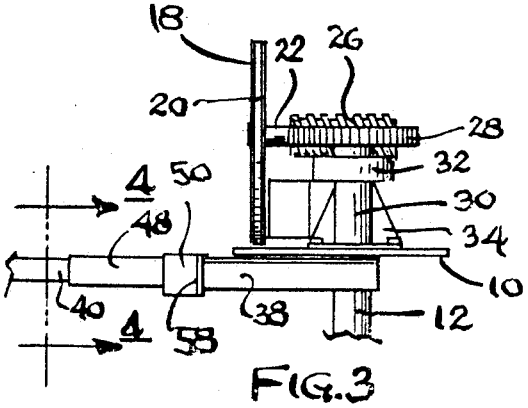
Figure 4:
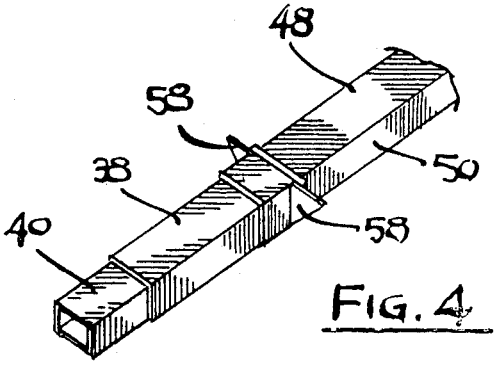
Figure 7:
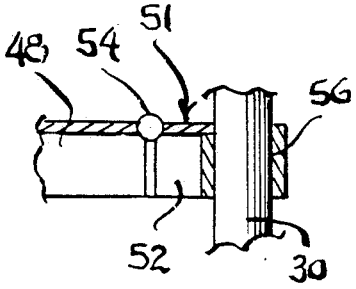
Figure 5:
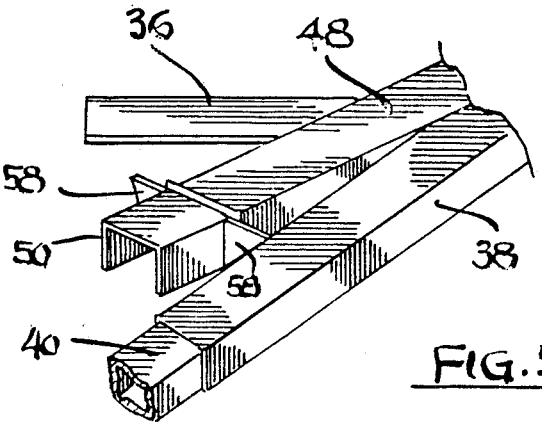

Having thus described our invention, reference will now be made to the accompanying drawings in which:

FIG. 1 is a perspective view of a gate opening and closing apparatus constructed in accordance with and embodying the present invention;

FIG. 2 is a side elevational view, partly in section, of a portion of the drive unit forming part of the gate opening and closing apparatus;

FIG. 3 is a fragmentary elevational view of the gate opening and closing apparatus of FIGS. 1 and 2;

FIG. 4 is a fragmentary perspective view of a coupling arm and a drive arm and latching arm showing the relative positioning of the coupling arm and drive arm and latching arm when the coupling arm and driving arm are latched together;

FIG. 5 is a fragmentary perspective view somewhat similar to FIG. 4, and showing the arrangement when the coupling arm is separated from the drive arm and when the latching arm is raised to permit such separation;

FIG. 6 is a fragmentary perspective view somewhat similar to FIGS. 4 and 5 and showing the arrangement of the latching arm and the drive arm and coupling arm when the drive arm and coupling arm are positioned to be latched with the latching arm; and FIG. 7 is a fragmentary sectional view showing a portion of the hinge joint for the latching arm.

DETAILED DESCRIPTION OF A PREFERRED EMBODIMENT

Referring now in more detail and by reference characters to the drawings which illustrate a preferred embodiment of the present invention, "A" designates a Gate Opening and Closing Apparatus shown with operative connections to a hingedly mounted gate which is swingable about a vertical axis and which is often referred to as a "swinging gate." In this case, the gate G is shiftable from a closed position across an access opening to the opened position and from the opened position to the closed position by means of the apparatus. The gate G may be part of any conventional construction and, as such, does not form part of the present invention per-se. The gate is also conventionally provided with rollers which are movable in a somewhat arcuate path along the ground or other supporting surface.

In essence, gates of this type are used with security apartment buildings and similar commercial establishments and dwelling structures. The access opening permits passage of either people or vehicles and the gate can be shifted from the closed to the opened position for such access. Generally, many commercially available prior art gate opening and closing apparatus operate with a radio frequency receiver-transmitter system, such that the party desiring to open the gate will actuate the transmitter to generate a signal which, in turn, causes the receiver to energize a motor for shifting the gate. In essence, transmitter-receiver systems of this type operate as a switch. In this respect, the apparatus of the present invention can be used with a key operated system or with the conventional radio frequency operated transmitter-receiver system.

The gate opening and closing apparatus A generally comprises a main supporting plate 10 which is supported, preferably in an elevated position with respect to the ground surface by means of a plurality of posts 12, as schematically shown in FIG. 1. In this embodiment, only two such posts are provided, which are, in turn, secured to a ground surface.

Mounted on the main plate 12 is a powered drive unit 14 which is comprised of an electric motor or similar drive unit 16 for driving a main fly-wheel 18 through a conventional drive belt 20. The drive belt 20 is also trained about a drive pulley 22 mounted on the drive shaft of the motor. The fly-wheel 18 is mounted on a horizontally disposed shaft 24, which, in turn, drives a pivotable screw or worm wheel or a so-called "worm gear" 26. The worm gear 26 meshes with a gear 28 mounted on a vertically disposed power shaft 30. This power shaft 30 is, in turn, journaled in a bracket 32 supported by gussets 34.

By reference to FIGS. 2 and 3, it can be observed that the powered shaft 30 extends through the mounting plate 10, as best illustrated in FIG. 3 of the drawings. Mounted on the powered shaft 30 and being rotatable thereby is a drive arm 36 and which is rotatable in a generally horizontal plane. In this embodiment of the invention, the drive arm 36 may adopt the form of a relatively flat plate. Also mounted on the powered shaft 30 is a coupling arm 38. The drive-arm 36 has its right-hand end rigidly mounted to the powered shaft 30 so that the drive arm 36 is rotatable thereby. The coupling arm 38, on the other hand, is loosely journaled about the drive shaft 30 so that it is not necessarily rotatable thereby. The drive arm is in the form of a relatively flat plate, as aforesaid. However, the coupling arm 38 is in the form of a rectangular structure as best illustrated in FIGS. 4 and 5. Moreover, the drive arm 36 is capable of being disposed under and registered with the side walls of the coupling arm 38, as best illustrated in FIGS. 4, 5 and 6 of the drawings.

The coupling arm 38 has its outer end pivotally connected to a connecting means in the form of a connecting arm 40. The connecting arm 40 is pivotally connected to the gate G through a pivot connection 42. In like manner, the connecting arm has a fitting 4 at its opposite end for pivotable connection to the coupling arm 38 through a pivot connection 46.

The latching arm 48 is also pivotally journaled about the powered shaft 30 and is rotatable thereabout. The latching arm is not necessarily driven by but is merely rotatable on the powered shaft 30, much in the same manner as the coupling arm 38. By reference to FIGS. 5 and 6 of the drawings, it can be observed that the latching arm 48 is generally of an inverted U-shaped construction. Moreover, the latching arm 48 has a pair of spaced apart vertically disposed side walls 50 which are adapted to extend over the vertical side walls of the coupling arm 38 in a loosely fitted engagement therewith, as best illustrated in FIG. 4 of the drawings.

The latching arm 48 is journaled about the powered shaft 30 through a bearing section 56 forming part of a knee joint section 51. This knee joint section is constructed so that the latching arm 48 can be raised and lowered with respect to the coupling arm 38 and the drive arm 36 and is also rotatable about the drive shaft 30. By further reference to FIG. 7, it can be observed that the knee joint section 51 comprises a section 52 at its right-hand end which includes the bearing section 56. The knee joint 51 merges into the latching arm 48 and is split to form a hinged end and is connected to the latching arm 48 through a pivot pin 54, which serves as an upper hinge section. Thus, the latching arm 48 is hingedly movable in an arcuate path so that it can be raised and lowered about the pin 54. The right hand end of the arm 48 and the left hand end of the section 52, reference being made to FIG. 7, would each have aligned openings or eyelets to receive and hold the pin 54.

In accordance with this construction, it can be observed that the coupling arm 38 is rotatable about the powered shaft 30 with the drive arm 36. Moreover, the latching arm 48 may be raised and lowered with respect to the coupling arm 38 in the matter as best illustrated in FIGS. 5 and 6 of the drawings.

The side walls 50 of the latching arm 48 have a depth greater than the vertical side walls of the coupling arm 38. In this way, the side walls 50 of the latching arm will extend below the side wall of the coupling arm 38. In accordance with this construction, the latching arm will hold the coupling arm to the powered drive arm 36, in the configuration as best illustrated in FIG. 4. When in this configuration, the coupling arm is driven by the powered shaft 30 through its latched engagement with the drive arm 36. Thus, the coupling arm, in effect, is powered for rotation in a horizontal plane through the powered shaft 30. By reference to FIG. 1, it can be observed that when the coupling arm 38 is powered for rotation in one direction, in a horizontal plane, it will move the gate to a closed position and when rotated in the opposite direction, it will move the gate G to the opened position.

In order to permit disengagement of the coupling arm 38 from the drive arm 36, it is only necessary to raise the latching arm 48, as in the arrangement as illustrated in FIGS. 5 and 6 of the drawings. When the latching arm 48 is raised, the coupling arm 38 is no longer latched to the drive arm 36 and will therefore not open and close the gate G through powered rotation. When in this arrangement, and due to the fact that the coupling arm 38 is loosely journaled about the powered shaft 30, the gate G can be manually and easily opened and closed.

Inasmuch as the latching arm 48 is loosely journaled about the powered shaft 30, it can be pivoted to a position out of the way of the coupling arm 38 and the drive arm 36 so that the gate G can be easily opened and closed by manual control. In this arrangement, the drive arm 36 will still rotate. However, the length of the drive arm 36 is relatively short and therefore will not cause any obstruction or potential injury. Indeed, it is only necessary to provide a relatively short drive arm 36 inasmuch as coupling arm 38 must have the necessary length to couple to the connecting arm 40.

The latching arm 48 is also provided on its vertically disposed side walls 50 with a pair of camming plates 58. These camming plates 58 are arranged so that if the coupling arm is moved toward the resting position of the latching arm 48, the camming plates will cause a raising movement of the latching arm 48 until it is disposed over the coupling arm 38. When in a position where the latching arm 48 is registered with the coupling arm 38, the latching arm 48 will automatically drop to the lowered position thereby causing a latching movement of the coupling arm 38. In like matter, when the powered drive arm 36 is rotated to a position where the latching arm 48 and the coupling arm 38 are disposed, it will likewise be coupled to the coupling arm 38 through the action of the camming plates 58. Thus, the latching arm can automatically latch the drive arm 36 to the coupling arm 38 after manual opening and closing of the gate G is no longer desired.

In accordance with the above, it can be observed that there is a relatively free and easy disconnection of the gate G from automatic control. In like manner, the gate G can easily be automatically reconnected for automatic opening and closing controlled movement.

In essentially all prior art opening and closing mechanisms, the motive means, such as the electric motor, is connected to the gate through a complex gear box, which enables the powered movement of the gate. However, in the event of a power failure, it is virtually impossible to push the gate to an opened position against the action of the gear box. The present invention obviates this problem of a complex gear box by providing a coupling arm which is journaled for rotation about the powered shaft but is not necessarily powered for rotation by the powered shaft.

Thus, there has been illustrated and described a unique and novel gate opening and closing apparatus and method which fulfills all of the objects and advantages which have been sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by letters patent is:

1. A gate opening and closing apparatus for automatically moving a gate between opened and closed positions and where the gate can be unlatched from the apparatus to permit manual opening and closing and easily re-latched for automatic movement thereof, said apparatus comprising:

(a) A powered drive unit (b) A drive arm powered by said drive unit and capable of movement between a pair of opposed end positions and where one end position represents a gate closed position and the other end position represents a gate opened position, (c) A coupling arm normally engaged with said drive arm and moveable therebetween two opposite end positions for enabling automatic movement of the gate between the gate opened and gate closed positions, said coupling arm capable of being shifted away from said drive arm to preclude automatic movement of the gate and thereby permit manual movement of the gate and capable of being shifted back to the engageable position with the drive arm to permit automatic driving movement of the gate, and (d) connecting means connected between said coupling arm and said gate to translate movement from said drive arm to said gate.

2. The gate opening and closing apparatus of claim 1 further characterized in that said drive arm is rotatable between the opposite end positions.

3. The gate opening and closing apparatus of claim 1 further characterized in that said drive arm rotates in a generally horizontal plane and that said coupling arm rotates in a generally horizontal plane.

4. The gate opening and closing apparatus of claim 1 further characterized in that said coupling arm is capable of being latched to said drive arm for movement simultaneously therewith.

5. The gate opening and closing apparatus of claim 1 further characterized in that a latching arm is operable with said coupling arm and said drive arm for latching said coupling arm to said drive arm.

6. The gate opening and closing apparatus of claim 5 further characterized in that said latching arm is capable of being disposed over said coupling arm and said coupling arm is capable of being disposed over said drive arm such that all three are in generally marginal registration and simultaneously rotatable in a horizontal plane.

7. The gate opening and closing apparatus of claim 6 further characterized in that said latching arm is also pivotally connected such that it is capable of being raised and lowered with respect to said drive arm and coupling arm.

8. The gate opening and closing apparatus of claim 7 further characterized in that a camming means is associated with said latching arm and automatically couples said drive arm and coupling arm when moved into the plane of the drive arm and coupling arm.

9. A method of opening and closing a gate automatically between gate opened and gate closed positions and unlatching the gate to permit manual movement thereof, said method comprising:

(a) latching a coupling arm to a drive arm in essential marginal registration, (b) causing rotatable movement of said coupling arm simultaneously with said drive arm, (c) causing movement of a gate between a gate opening and gate closed position with the movement of the drive arm and the coupling arm, and (d) unlatching said coupling arm from said drive arm to thereby permit manual opening and closing movement of said gate.

10. The method of claim 9 further characterized in that said method comprises latching said coupling arm to said drive arm with a latching arm such that the latching arm is disposed over said coupling arm and drive arm in marginal registration therewith.

11. The method of claim 10 further characterized in that said method causes movement of said drive arm and coupling arm in a generally horizontal plane.

12. The method of claim 10 further characterized in that said method comprises pivoting said latching arm in a vertical plane to permit disengagement of said coupling arm from said drive arm.

13. A drive apparatus for moving a gate between gate opened and closed positions on an automatic basis and permitting easy separation of the gate from the drive apparatus, said apparatus comprising:

(a) power drive means, (b) a drive arm rotatable by said drive means, (c) a coupling arm pivotal with respect to said drive means and capable of being latched to said drive arm, (d) a latching arm for causing latching movement of said coupling arm to said drive arm, and (e) means for connecting said coupling arm to said gate.

14. The gate opening and closing apparatus of claim 13 further characterized in that said coupling arm and said drive arm and latching arm are all disposed in marginal registration when said coupling arm is latched to said drive arm.

15. The gate closing and opening apparatus of claim 13 further characterized in that said coupling arm and said drive arm and said latching arm all generally rotate in a horizontal plane.

* * * * *